US006592425B2

(12) United States Patent
Bapst et al.

(10) Patent No.: US 6,592,425 B2
(45) Date of Patent: Jul. 15, 2003

(54) INFANT ACTIVITY CENTER

(75) Inventors: David M. Bapst, South Wales, NY (US); John Francis Rhein, Hamburg, NY (US); Jennifer A. Schroth, Buffalo, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 09/968,499

(22) Filed: Oct. 2, 2001

(65) Prior Publication Data

US 2003/0064659 A1 Apr. 3, 2003

(51) Int. Cl.[7] ..... A63H 33/00

(52) U.S. Cl. ..... 446/227; 446/397; 446/484; 5/655

(58) Field of Search ..... 446/227, 228, 446/486, 397, 408, 484; 482/131–132, 129, 121–123; 5/108, 655; 472/98; 297/DIG. 11, 217.3, 241, 274

(56) References Cited

U.S. PATENT DOCUMENTS 704,774 A 7/1902 Blackledge 1,436,367 A 11/1922 Sullivan (List continued on next page.)

FOREIGN PATENT DOCUMENTS

EP 0995382 A1 * 4/2000
GB 2279265 A 1/1995

OTHER PUBLICATIONS www.netkidswear.com, see attached.*

*Primary Examiner*—Derris H. Banks
*Assistant Examiner*—Jamila Williams
(74) *Attorney, Agent, or Firm*—Cooley Godward LLP

(57) ABSTRACT

An activity center is disclosed that includes a first section and a second section. In one embodiment, a removable connection between the first section and the second section enables detection of infant activity by an actuator in the first section to produce sensible output in the second section. In another embodiment, a connection between a first section that includes a support frame capable of supporting an infant enables detection of infant activity by an actuator in one of the sections to produce sensible output in the other section.

12 Claims, 13 Drawing Sheets

U.S. PATENT DOCUMENTS 1,659,572 A 2/1928 Klemm
2,200,993 A 5/1940 Marshall
2,282,881 A 5/1942 Ostrow
2,402,861 A 6/1946 Winnick
2,567,418 A * 9/1951 Barker
3,692,359 A 9/1972 Boucher
4,008,500 A 2/1977 Hall, Jr.
4,123,102 A 10/1978 Landry et al.
4,188,745 A 2/1980 Harvey et al.
4,500,133 A 2/1985 Nakao et al.
4,551,114 A 11/1985 Hyman et al.
4,553,786 A 11/1985 Lockett, III et al.
4,561,549 A * 12/1985 Yokohori ..... 211/182
4,627,588 A * 12/1986 Block ..... 248/163.2
4,664,640 A 5/1987 Shindo et al.
4,973,286 A * 11/1990 Davison ..... 446/175
5,057,051 A 10/1991 Babicz
5,178,438 A 1/1993 Beger
5,187,826 A * 2/1993 Mariol ..... 5/655
5,242,338 A 9/1993 Hartdegan, III et al.
5,245,558 A 9/1993 Hachey
5,254,007 A 10/1993 Eagan
5,411,315 A 5/1995 Greenwood
5,411,457 A * 5/1995 Hartdegen, III et al. ..... 482/96
5,451,095 A 9/1995 Riback
5,464,381 A 11/1995 Wilson
5,478,268 A * 12/1995 Au ..... 446/227
5,487,705 A 1/1996 Clarke
5,509,721 A 4/1996 Huang
5,518,475 A * 5/1996 Garland ..... 482/68
5,857,944 A * 1/1999 Cone et al. ..... 482/66
5,868,459 A 2/1999 Welsh, Jr.
5,887,945 A 3/1999 Sedlack
6,000,761 A * 12/1999 Rocha ..... 297/464
6,016,926 A 1/2000 Smith, II et al.
6,068,285 A * 5/2000 Jackson et al. ..... 280/650
6,113,455 A 9/2000 Whelan et al.
6,132,283 A 10/2000 O'Donnell et al.
6,149,489 A * 11/2000 Johnson ..... 446/227
6,174,028 B1 1/2001 Yang et al.
6,203,395 B1 3/2001 McElhaney

* cited by examiner

INFANT ACTIVITY CENTER

BACKGROUND OF THE INVENTION

This invention relates generally to infant activity centers, and more particularly to electronic infant activity centers.

Activity centers provide infants with many developmental benefits. This is true even if an infant cannot physically interact with the activity center. In this case, infants can receive audio and visual stimulation using activity centers that can be set in motion either manually or automatically.

As the infant develops, the infant will increase his (or her) physical interaction with the activity center. This physical interaction further encourages the development of physical attributes such as hand-eye coordination, range of motion, etc. Most conventional activity centers are designed to encourage interaction with the infant's hands. Here, effective activity-center designs enable infants to interact with the activity center with minimal directed hand coordination. More recent activity center designs have now begun to incorporate interactive elements that interact with an infant's feet.

SUMMARY OF THE INVENTION

An activity center is disclosed that includes a first section and a second section. In one embodiment, a removable connection between the first section and the second section enables detection of infant activity by an actuator in the first section to produce sensible output in the second section. In another embodiment, a connection between a first section that includes a support frame capable of supporting an infant enables detection of infant activity by an actuator in one of the sections to produce sensible output in the other section.

DETAILED DESCRIPTION OF THE INVENTION

An embodiment of the invention is discussed in detail below. While specific implementations are discussed, it should be understood that this is done for illustration purposes only. A person skilled in the relevant art will recognize that other components and configurations may be used without departing from the spirit and scope of the invention.

Figure 1:
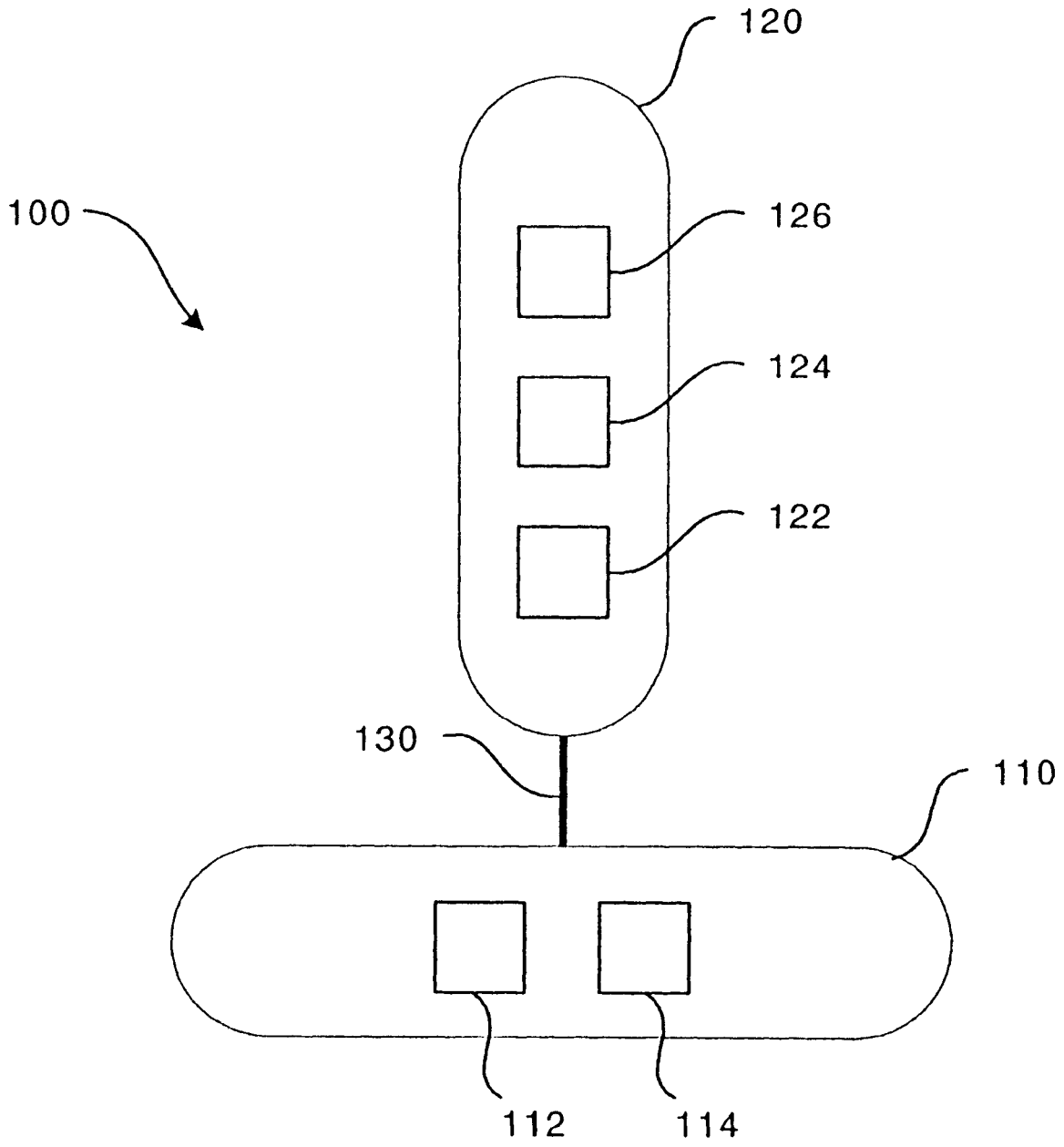
FIG. 1 is a functional view of an embodiment of an activity center.

FIG. 1 is a functional view of an embodiment of activity center 100. Activity center 100 includes first section 110 and second section 120. In the illustrated embodiment, first section 110 includes infant entertainment component 112 and actuator component 114, while second section 120 includes infant entertainment component 122 and actuator component 124. As would be appreciated, first section 110 and second section 120 can include multiple infant entertainment components and multiple actuator components. For simplicity, only a single entertainment component and a single actuator component have been illustrated on first section 110 and second section 120.

As would be appreciated, entertainment components 112, 122 can represent any entertainment component that produces a sensory effect on an infant. For example, entertainment components 112, 122 can include audio generation components, visual generation components, or motor driven components.

In general, actuators 114, 124 are operative to detect some form of infant activity. For example, in one embodiment, actuators 114, 124 can be designed to detect movement of an infant, while in another embodiment actuators 114, 124 can be designed to detect a verbal action by an infant. In accordance with the present invention, detected infant action is used to control the activation or state of one or more infant entertainment components 112, 122. As would be appreciated, actuators 114, 124 can be designed to directly control an infant entertainment component 112, 122 or can be used as an input to an infant entertainment control program.

Control over such an infant entertainment control program is enabled through an electronic control unit 126. In the illustrated embodiment of FIG. 1, electronic control unit 126 is included within second section 120. As would be appreciated, in an alternative embodiment, electronic control unit 126 is included within first section 110.

Electronic control unit 126 is operative to receive a set of control inputs. Particular control inputs can be received from actuators disposed in the section within which the electronic control unit resides, or from actuators disposed in the section within which the electronic control unit does not reside. For example, electronic control unit 126 in second section 120 can receive a control input generated by actuator component 124 in second section 120, and a control input generated by actuator component 114 in first section 110. If the actuator component is not disposed in the same section as the electronic control unit, then the communication between the actuator component and the electronic control unit is enabled through communication link 130. Communication link 130 is generally designed to enable communication between electronic components that are disposed in different sections of activity center 100. Communication link 130 can be embodied as a wired or wireless connection.

Figure 2:
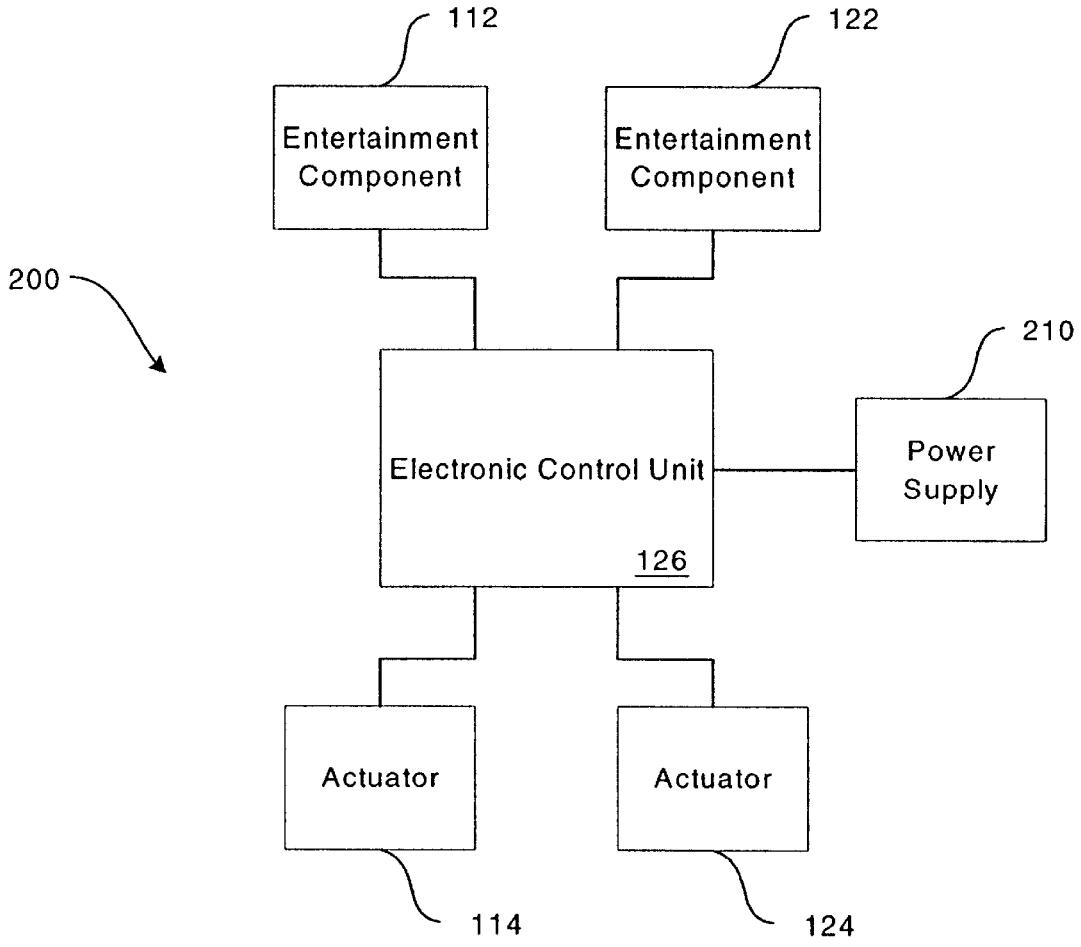
FIG. 2 is a schematic illustration of the control system of the embodiment of FIG. 1.

To more clearly illustrate the connectivity of electronic control unit 126, reference is made to schematic diagram 200 of FIG. 2. Electronic control unit 126 can be designed to individually control the activation or state of a set of entertainment components 112, 122.

Electronic control unit 126 is also coupled to a power supply 210. Power supply 210 can be used to power both electronic control unit 126 as well as one or more of entertainment components 112, 122. As would be appreciated, one or more of entertainment components 112, 122 can also be individually powered by separate power supplies with control being provided by electronic control unit 126.

As noted, control over entertainment components 112, 122 is effected by electronic control unit 126 in response to a general set of infant generated controls. Infant generated controls are exemplified by actuators 114, 124 and can be disposed in any section 110, 120 of activity center 100. In general, an infant generated control represents any input to electronic control unit that is generated by a detectable infant action. For example, the detectable infant action can be based on any physical or audible effect generated by the infant.

The flexibility of the placement of actuators 114, 124 relative to electronic control unit 126 is enabled through communication link 130. This flexibility in the placement of the actuators relative to the electronic control unit enables various configurations of activity center 100.

In one embodiment, first section 110 is a base portion of an activity center, while second section 120 is an infant entertainment portion. The base portion and the infant entertainment portion are removably coupled via a removable coupler that includes communication link 130.

In general, the base portion represents a portion of the activity center that includes an actuator and that can be positioned proximate to the infant. As would be appreciated, the specific form of the base portion can vary depending upon the type of activity center (e.g., bouncer seat, playpen activity center, crib, infant stroller, infant high-chair, infant activity gym, etc.) in which it is embodied. Regardless of the form, the base portion is designed to position the actuator proximate to the infant. This proximate positioning can be accomplished in a variety of ways. For example, in one embodiment, the base portion can be designed to support the infant, while in another embodiment, the base portion can be designed to be placed relative to an infant.

After the base portion is positioned proximate to the infant, the infant can activate the actuator. Control signals indicative of the activation of the actuator are carried over a communication link to the removable infant entertainment portion (e.g., an activity bar) that includes an electronic control unit. The electronic control unit can then control the entertainment components throughout the activity center based at least in part on the control signal received over the communication link. As noted, the communication link can be incorporated into a removable coupler that connects the base portion and the removable infant entertainment portion. It can also be independent of the removable coupler.

Figure 3:
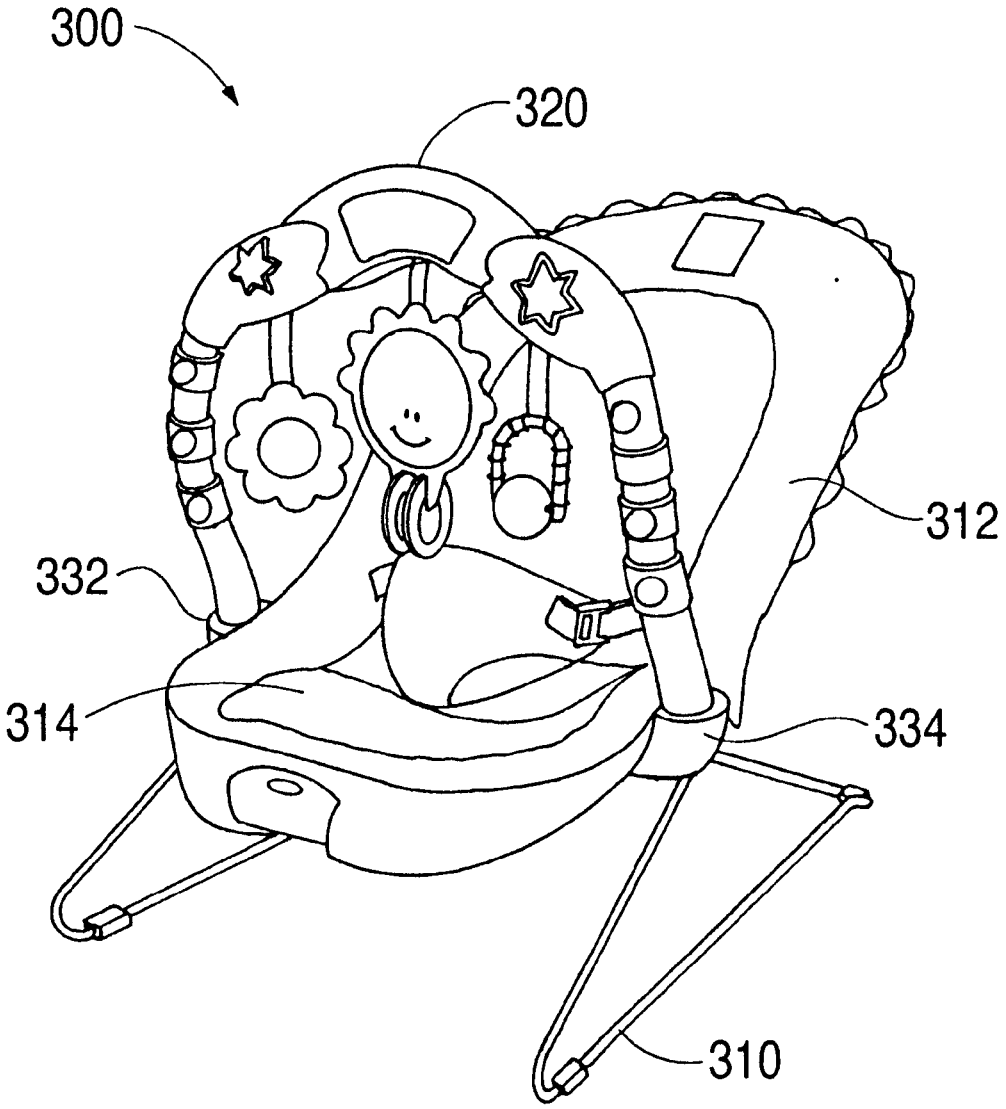
FIG. 3 is a perspective view of an embodiment of an activity center.

To more clearly illustrate the principles of the present invention, reference is made to FIG. 3, which illustrates a perspective view of infant activity center 300. With further reference to the functional embodiment of FIG. 1, infant activity center 300 can be described in terms of a first section and a second section. Here, the first section includes bouncer support frame 310, which supports seating surface 312. When an infant is supported by seating surface 312, the infant's legs are positioned relative to foot actuator section 314. The second section includes activity bar 320, which further includes various infant entertainment components. Activity bar 320 is coupled to bouncer support frame 310 via retainer elements 332 and 334. As will be described in greater detail below, retainer element 334 includes a communication link that enables communication between foot actuator section 314 and an electronic control unit disposed in activity bar 320.

Figure 4:
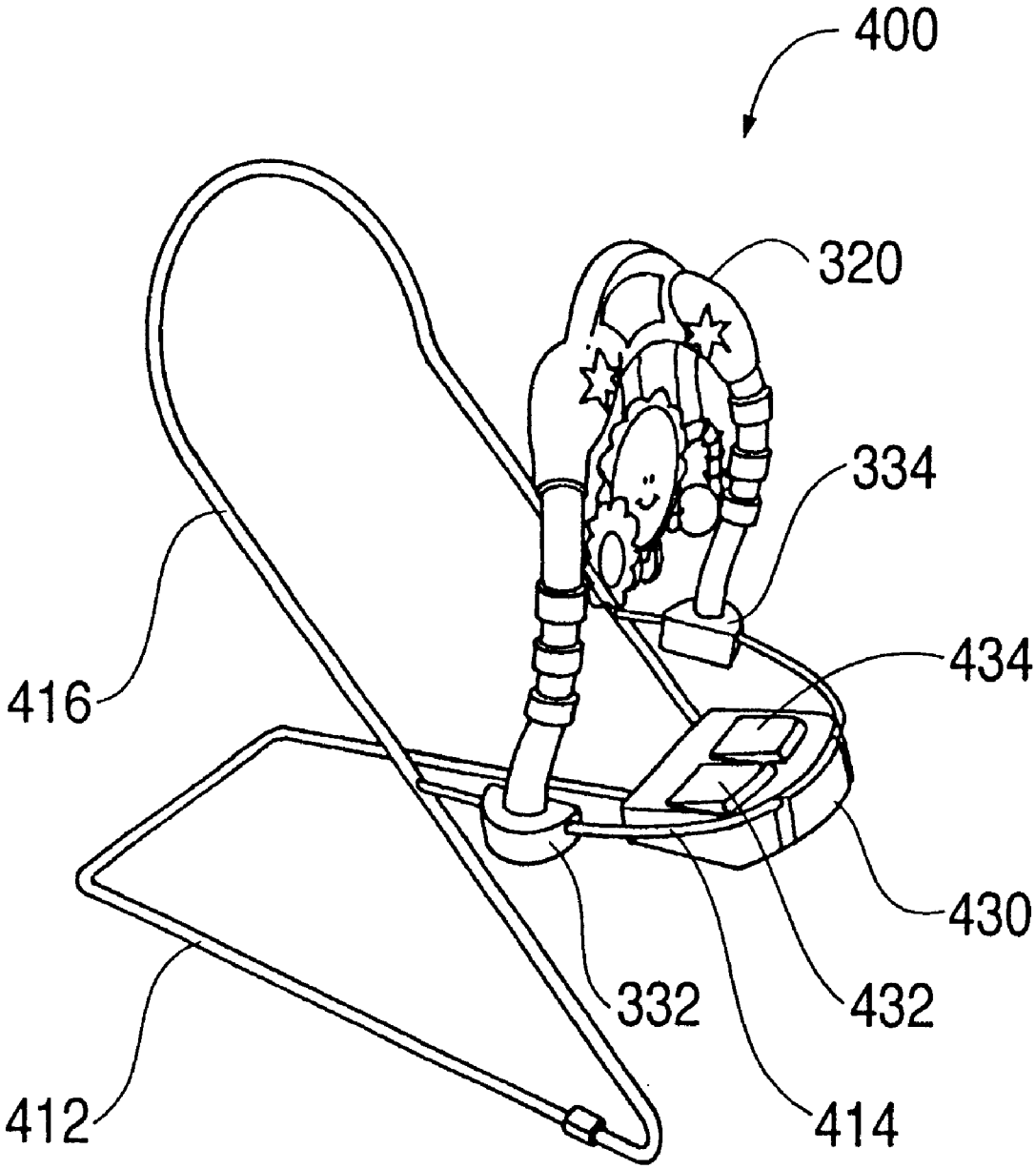
FIG. 4 is a perspective view of the underlying components of the embodiment of FIG. 3.

FIG. 4 is a perspective view of infant activity center 300 with seating surface 312 removed. As illustrated, infant activity center 300 includes a bouncer support frame including base section 412, leg support section 414, and back support section 416. The combination of back support section 416 and leg support section 414 enables infant activity center 300 to support an infant in a partially reclined posture. As will become apparent from the following description, the concepts of the present invention can be applied to any modular or integrated infant support structure.

As illustrated in FIG. 4, activity bar 320 has end members that can be slideably engaged with retainer elements 332, 334, which are disposed on leg support section 414. The slideable engagement enables a removable coupling between activity bar 320 and the bouncer support frame. Also disposed on leg support section 414 is foot actuator console 430. Foot actuator console 430 further includes foot actuator buttons 432, 434 that can be pressed by feet of an infant when the infant is supported by the bouncer support frame.

As will be described in detail below, foot actuator buttons 432, 434 on foot actuator console 430 activate respective actuators that are operatively coupled to an electronic control unit disposed in activity bar 320. This operative coupling enables the detection of infant foot activity to be used as an input into an electronically controlled infant entertainment system. In the illustrated embodiment of FIGS. 3 and 4, the electronically controlled infant entertainment system includes infant entertainment components that are disposed on activity bar 320. In further embodiments, infant entertainment components can also be disposed on the bouncer support frame.

Figure 5:
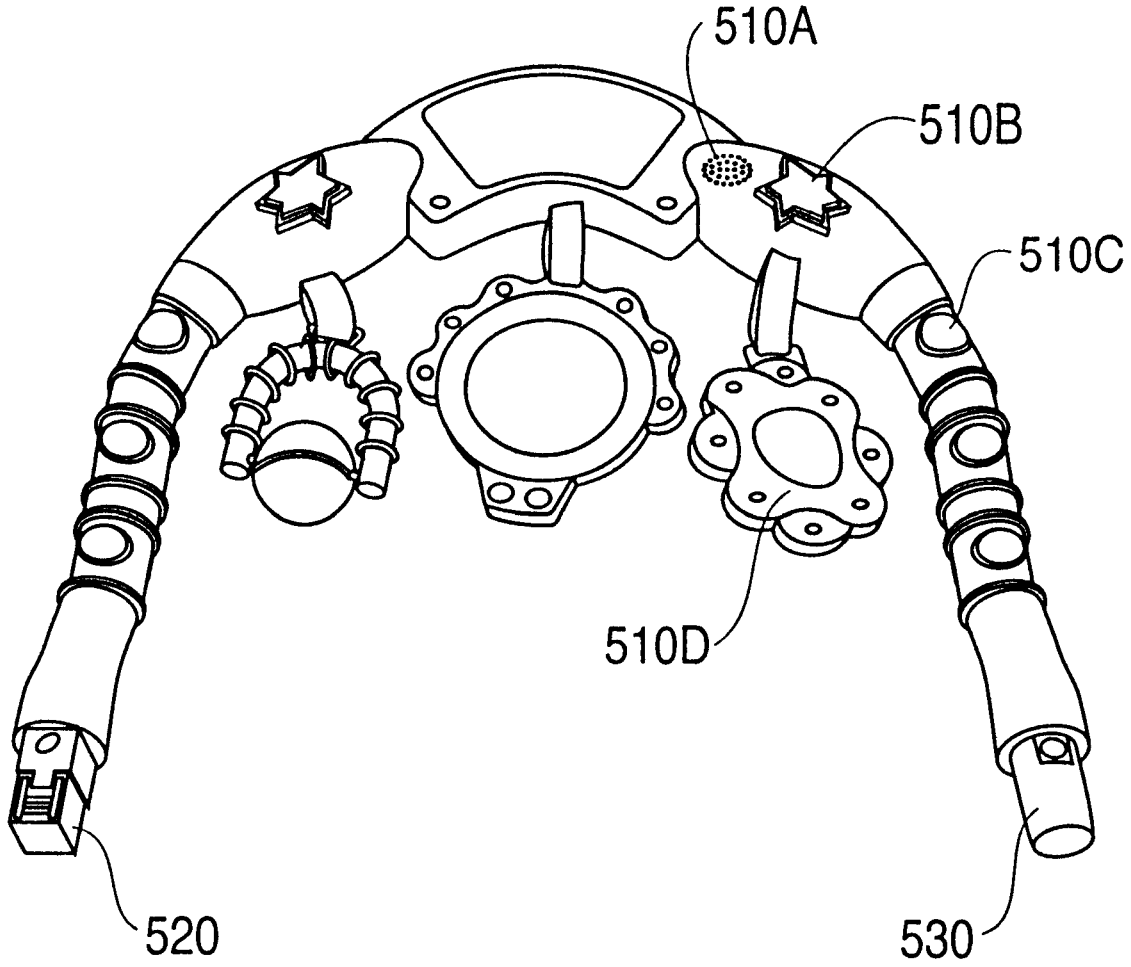
FIG. 5 is a rear view of the activity bar of the embodiment of FIG. 3.

FIG. 5 is a rear view of an embodiment of activity bar 320. Activity bar 320 includes a variety of infant entertainment components including an audio speaker component 510A, visual components 510B, 510C, and hanging component 510D. In various embodiments, all or part of the set of infant entertainment components disposed on activity bar 320 can be activated or controlled by an infant entertainment program that is responsive to a set of actuators.

As further illustrated in FIG. 5, activity bar 320 also includes end members 520, 530. End members 520 and 530 can be slideably engaged with retainer elements 334 and 332, respectively. In the illustrated embodiment, end member 530 and retainer element 332 have a circular cross section, while end member 520 and retainer element 334 have a rectangular cross section. This design configuration dictates that end members 520, 530 can only be received by corresponding retainer elements 332, 334. As will be described in greater detail below, end member 520 enables foot actuator console 430 to be operatively coupled to an electronic control unit disposed in activity bar 320.

Figure 6A:
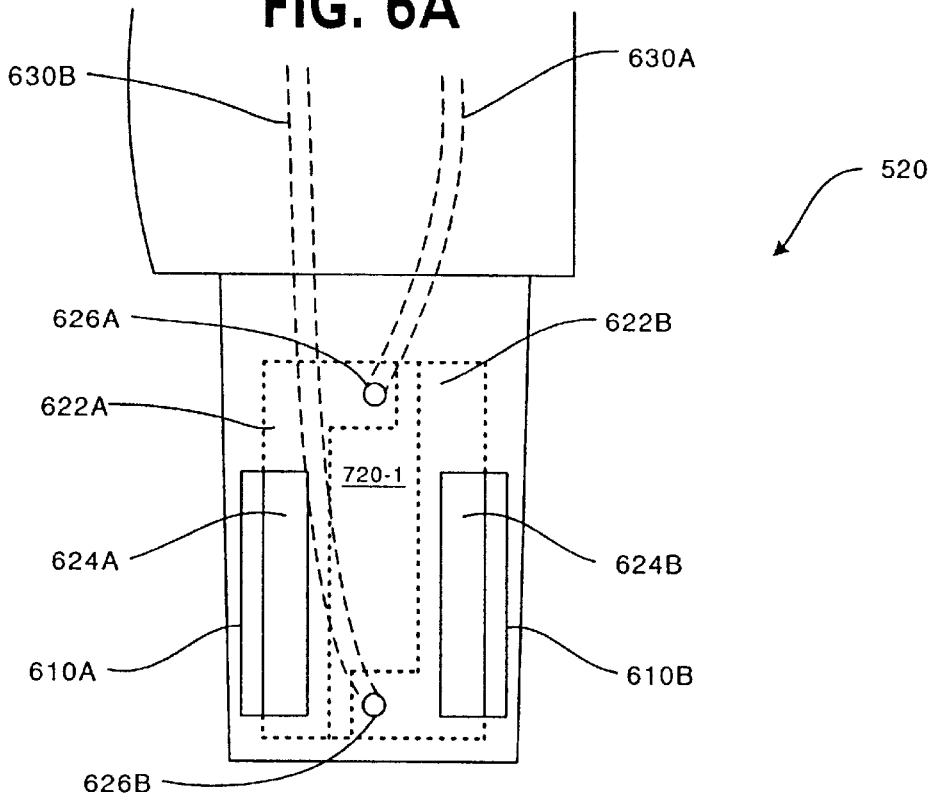
FIGS. 6A and 6B are fragmentary cross-sectional views of the activity bar coupler of the embodiment of FIG. 3.

FIG. 6A is a fragmentary cross-sectional front view of end member 520. As illustrated in FIG. 6A, a first side of end member 520 includes two window sections 610A, 610B that expose a pair of electrical contacts. When end member 520 is slideably engaged with retainer member 334, the exposed electrical contacts of end member 520 are coupled to corresponding electrical contacts of retainer member 334.

In the illustrated embodiment, the exposed electrical contact 624A represents a portion of electrical trace 622A that is embodied in printed wiring board 620-1. Electrical contact 622A is further connected to wire conductor 630A via electrical contact junction 626A. Similarly, the exposed electrical contact 624B is a portion of electrical trace 622B, which is connected to wire conductor 630B via electrical contact junction 626B.

Figure 6B:
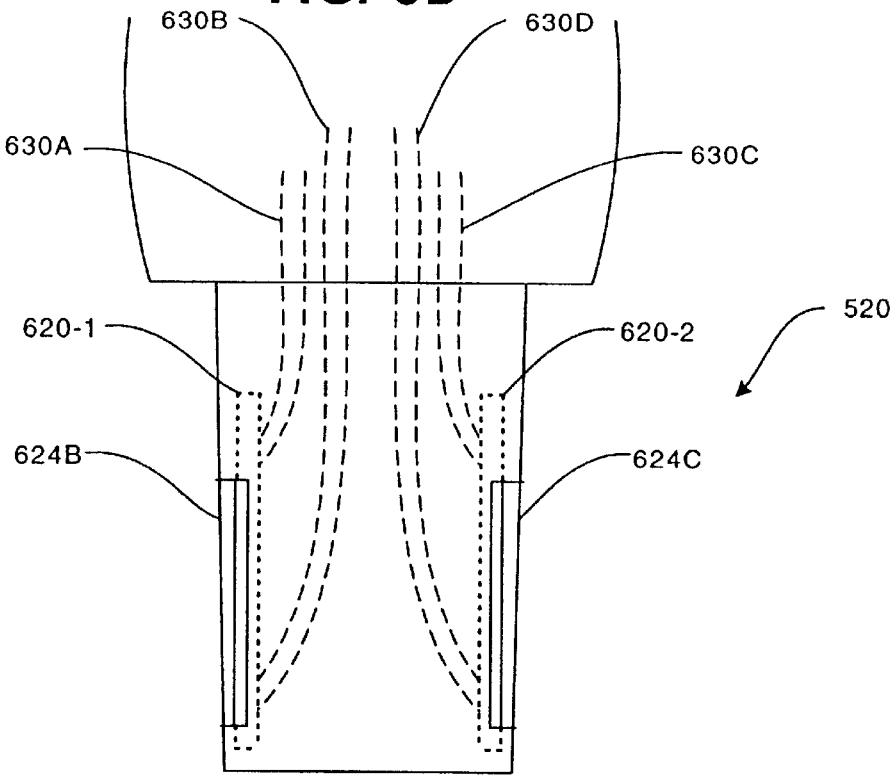

FIG. 6B is a fragmentary cross-sectional right side view of end member 520. As illustrated, end member 520 includes two printed wiring boards 620-1 and 620-2. Printed wiring board 620-1 exposes a first pair of electrical contacts 624A, 624B that are coupled to wire conductors 630A, 630B, while printed wiring board 620-2 exposes a second pair of electrical contacts that are coupled to wire conductors 630C, 630D. In general, the two pairs of electrical contacts enable an electronic control unit in activity bar 320 to detect the activation of actuators disposed on the bouncer support frame.

Figure 7:
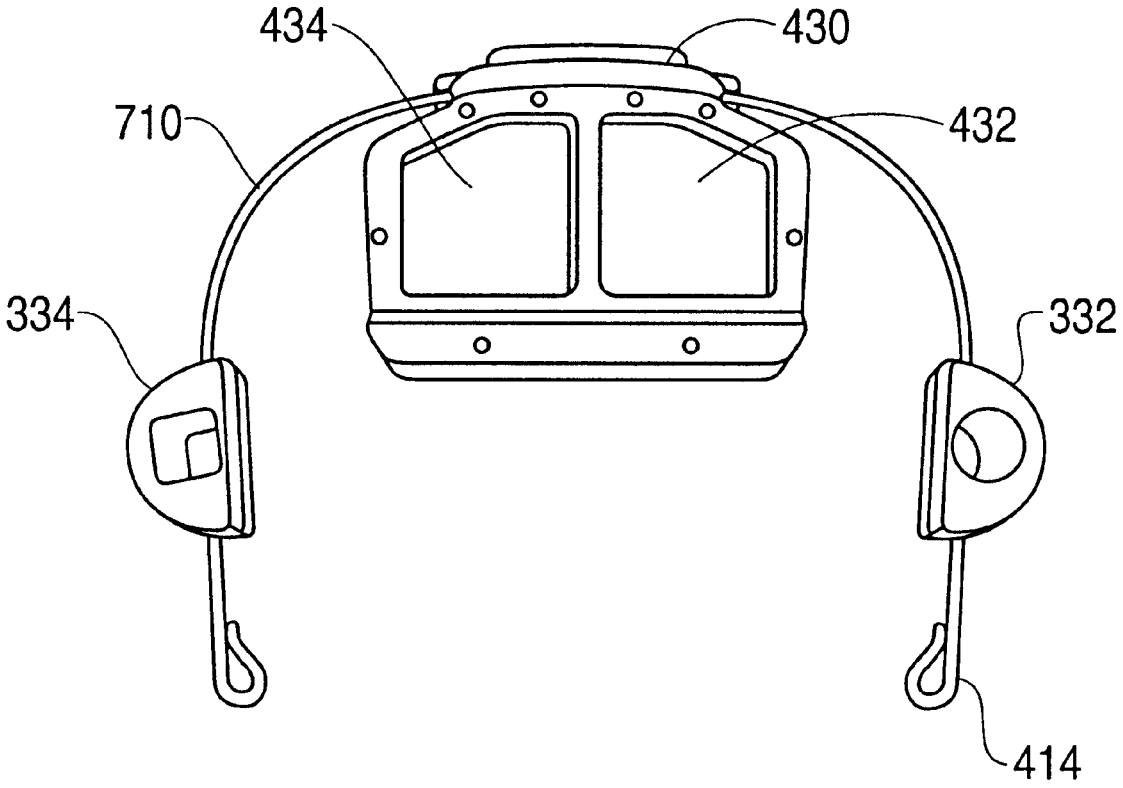
FIG. 7 is a top view of the leg support portion of the support frame of the embodiment of FIG. 3.

FIG. 7 is a top view of leg support section 414 of the bouncer support frame. As noted, retainer members 332, 334 and foot actuator console 430 are disposed on leg support section 414. Detection of the activation of the actuators by foot actuator buttons 432, 434 are enabled through conductor cable 710. Conductor cable 710 connects the actuators within foot actuator console 430 to respective electrical contacts in retainer member 334.

Figure 8A:
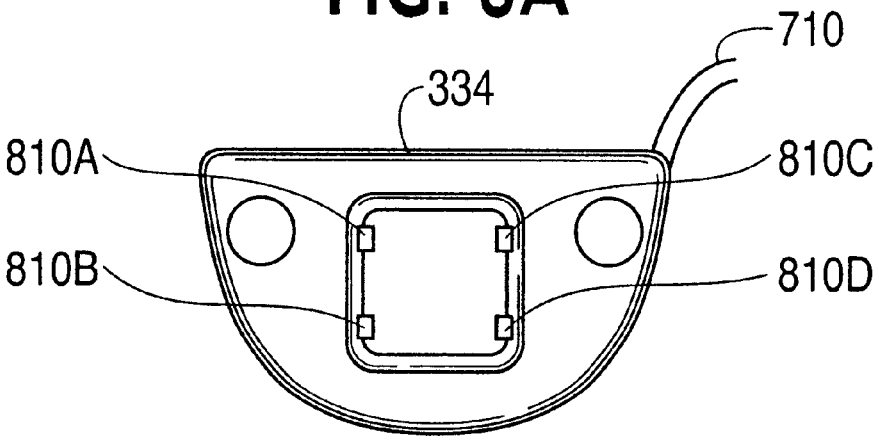
FIGS. 8A and 8B are top and internal views of the member end of the activity bar of the embodiment of FIG. 3.

FIG. 8A is a top view of retainer member 334. As illustrated, retainer member 334 includes a recess having a rectangular cross section that is designed to be engaged with end member 520 of activity bar 320. Disposed on opposite walls of the rectangular recess are electrical contacts 810A, 810B, 810C, and 810D. Electrical contacts 810A, 810B, 810C, and 810D are coupled to the electrical contacts of end member 520 when end member 520 is slideably engaged with retainer member 334.

Figure 8B:
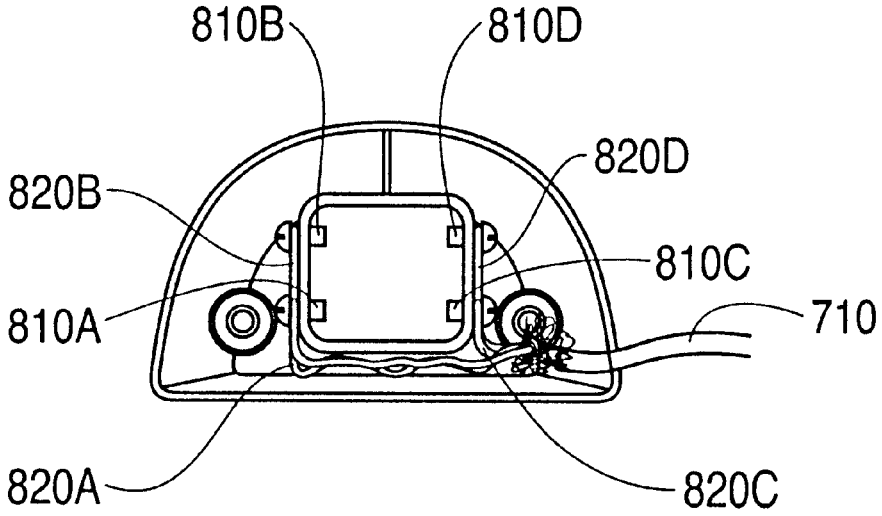

FIG. 8B is an internal view of retainer member 334. As illustrated, electrical contacts 810A, 810B, 810C, and 810D are coupled to wire conductors 820A, 820B, 820C, and 820D, respectively. Wire conductors 820A, 820B, 820C, and 820D are enclosed within conductor cable 710.

Figure 9A:
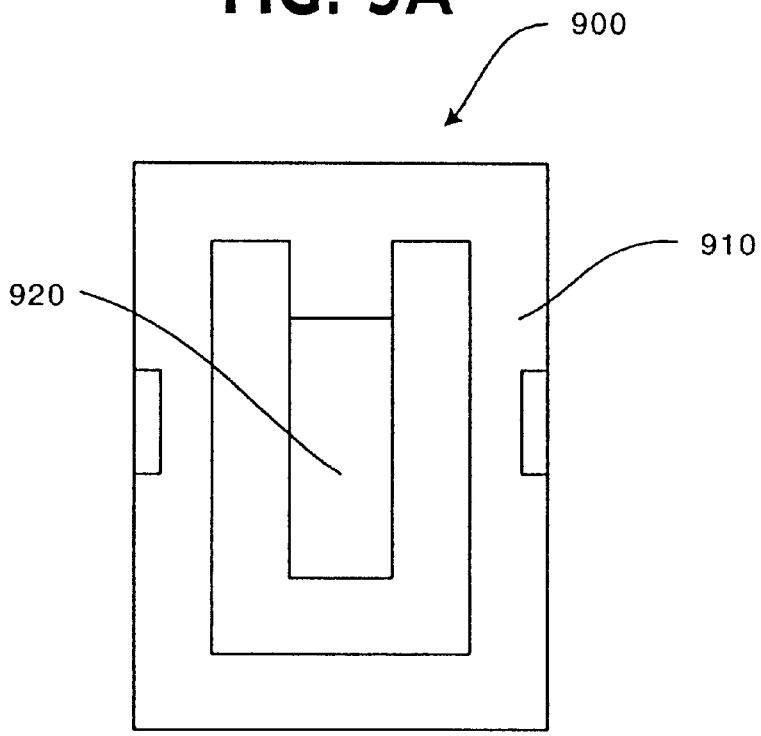
FIGS. 9A and 9B are front and side views of the electrical contact in the member end of FIGS. 8A and 8B.
Figure 9B:
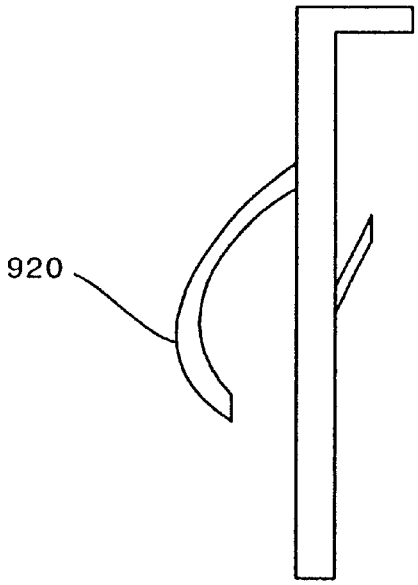

FIGS. 9A and 9B are front and side views, respectively, of an electrical contact that is disposed within retainer member 334. Electrical contact 900 includes a perimeter portion 910 and a contact portion 920. Perimeter portion 910 of electrical contact 900 is configured to be slideably engaged within a slot in retainer member 334. Once engaged with retainer member 334, contact portion 920 of electrical contact 900 is exposed along the surface of the rectangular recess of retainer member 334. The exposed contact portion 910 of electrical contact 900 can then be engaged with contact portion 624 of end member 520.

Figure 10:
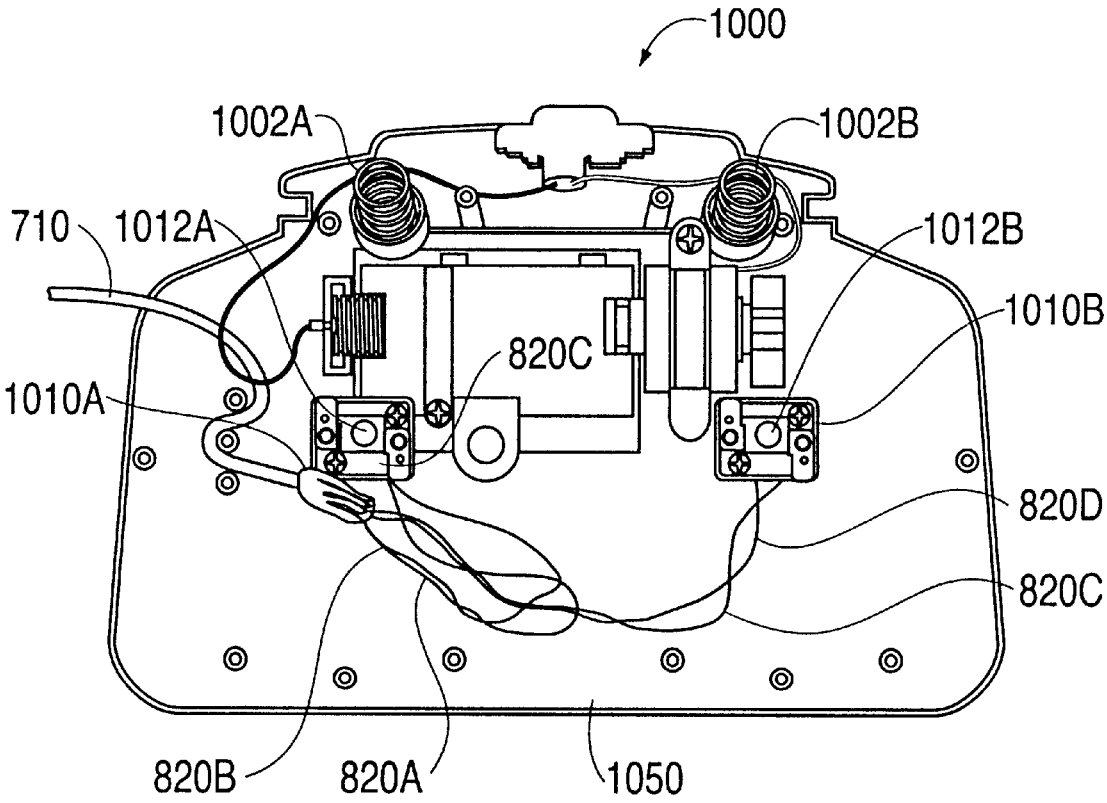
FIG. 10 is an internal view of the foot actuator console of the embodiment of FIG. 3.

As noted, conductor cable 710 connects the foot actuators within foot actuator console 430 to respective contacts 900 in retainer member 334. This connection is further illustrated in FIG. 10, which is an internal view of foot actuator console 430. Foot actuator console 430 includes foot actuators 1010A, 1010B, which are disposed in a foot actuator console casing 1050. Foot actuators 1010A, 1010B are designed to detect movement in a foot of an infant that is supported by the bouncer support frame.

In the illustrated embodiment, foot actuators 1010A and 1010B include switch elements 1012A and 1012B, respectively, that will create a connection between two wire conductors when the switch element 1012A, 1012B is depressed. The closing of the connection of the two wire conductors represents an event that is detectable by the electronic control unit. In the illustrated embodiment, switch element 1012A is used to connect wire conductors 820A and 820B, while switch element 1012B is used to connect wire conductors 820C and 820D.

Figure 11:
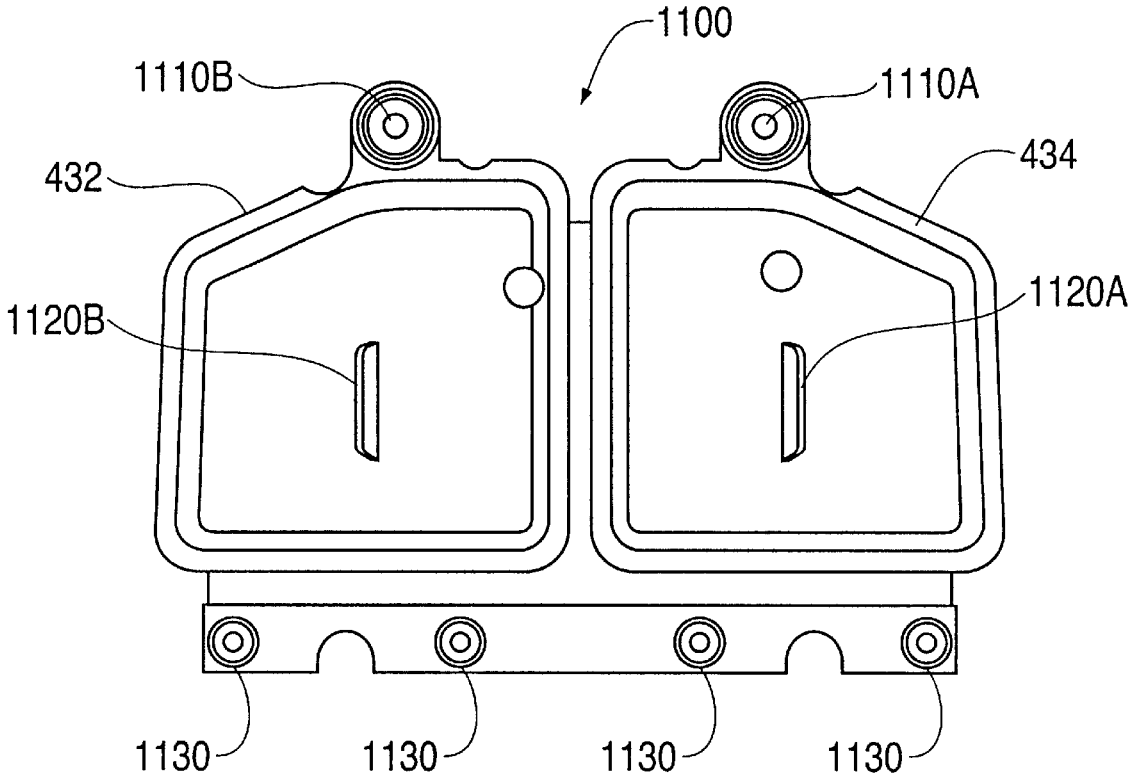
FIG. 11 is an internal view of the foot actuator buttons of the embodiment of FIG. 3.

Switch elements 1012A, 1012B are depressed by foot actuator buttons 434, 432, respectively. FIG. 11 is an internal view of foot actuator buttons 432, 434. Each foot actuator button 432, 434 includes a recessed element 1110A, 1110B and a switch trigger element 1120A, 1120B. Recessed elements 1110A, 1110B are operative to receive a respective spring 1002A, 1002B that is supported within actuator console 430. Foot actuator buttons 432, 434 are fastened to foot actuator console casing 1050 using recessed elements 1130.

Figure 12:
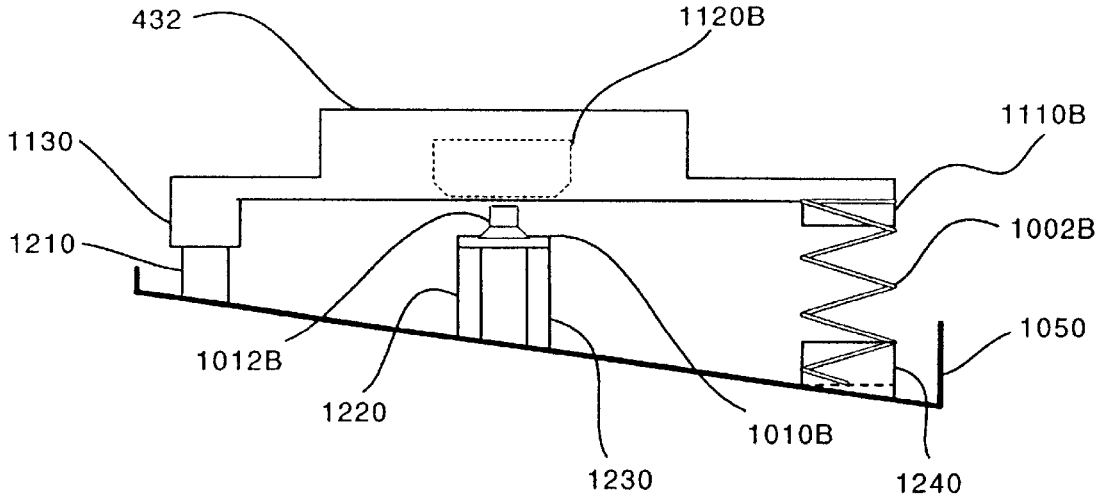
FIG. 12 is a cross-sectional view of the foot actuator console of the embodiment of FIG. 3.

FIG. 12 is a fragmentary cross-sectional view of foot actuator console 430 showing the engagement of switch element 1012B by switch trigger element 1120B of foot actuator button 432. As illustrated, a first end of foot actuator button 432 is fastened to foot actuator console casing 1050 through the alignment of recessed element 1130 with member support 1210, which protrudes from foot actuator console casing 1050. The second end of foot actuator button 432 is supported by spring 1002B. Spring 1002B is disposed between recessed element 1110B of foot actuator button 432 and recessed element 1240 of foot actuator console casing 1050.

Spring 1002B provides a biasing function that suspends switch trigger element 1120B of foot actuator button 432 above switch element 1012B. Switch element 1012B is mounted on foot actuator 1010B, which in turn is mounted on foot actuator console casing 1050 using member supports 1220, 1230. When actuator buttons 432 and 434 are supported by springs 502A and 502B, respectively, switch trigger elements 1120A and 1120B are suspended above switch elements 1012B and 1012A, respectively.

When an infant supported by the bouncer support frame presses one of the actuator buttons 132, 134 with one of his (or her) feet, the respective switch trigger element 1120A, 1120B depresses the corresponding switch element 1012A, 1012B, thereby creating a connection between the two wire conductors connected to the particular actuator 1010A, 1010B. The connection between the two wire conductors represents an event that is detectable by the electronic control unit. As noted, wire conductors 820A, 820B, 820C, 820D that are coupled to actuators 1010A, 1010B within foot actuator console 430 are also coupled to the electronic control unit within activity bar 320 through the electrical connections enabled through the engagement of end member 520 and retainer member 434.

Figure 13:
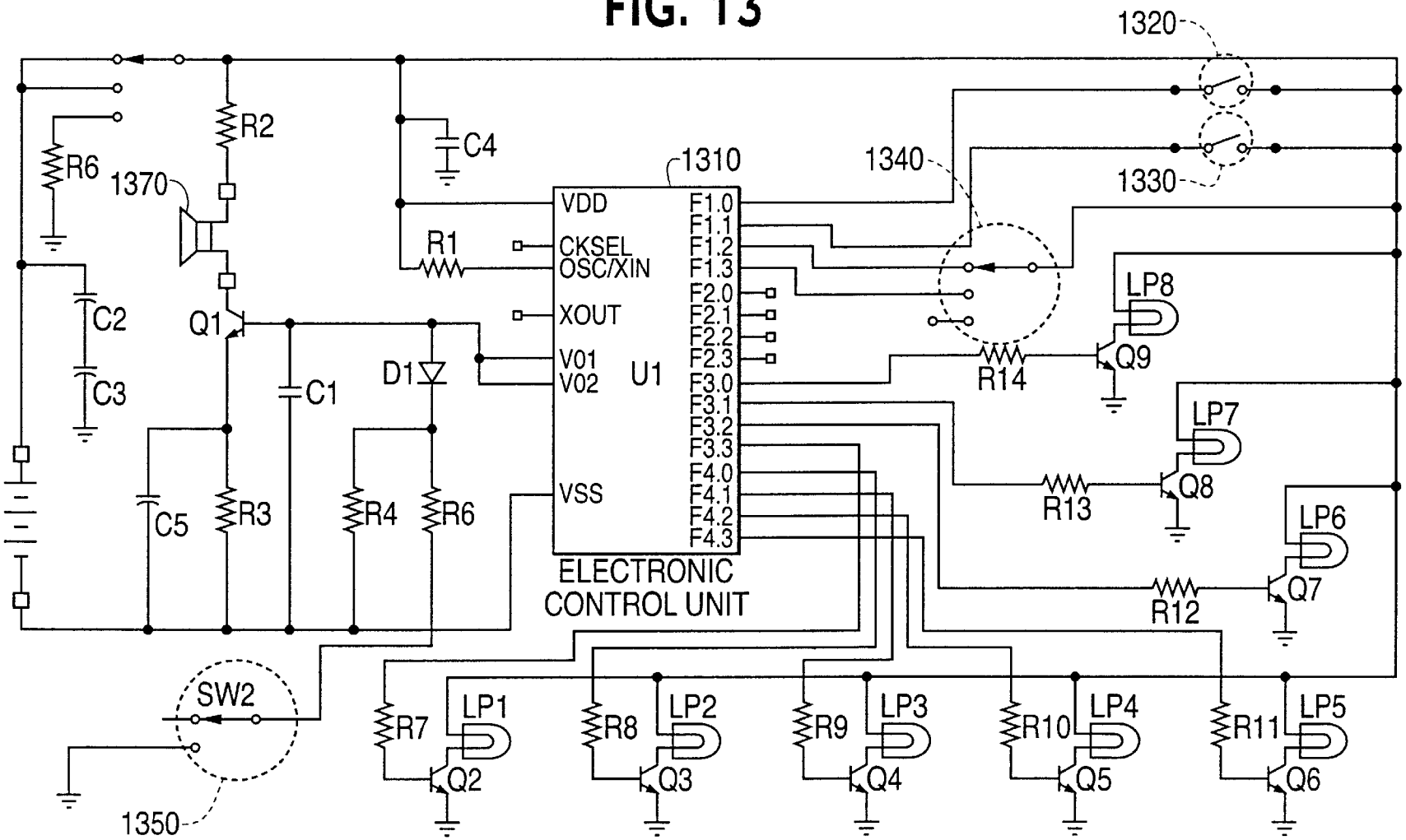
FIG. 13 is a control circuit diagram of the embodiment of FIG. 3.

FIG. 13 is a schematic circuit diagram that illustrates the connectivity between the electronic control unit and the various control inputs and entertainment components. A first set of control inputs to electronic control unit 1310 is the set of foot switches 1320, 1330. In the illustrated embodiment of FIG. 12, foot switches 1320, 1330 can be activated through the depression of a switch element 1012A, 1012B by a switch trigger element 1120A, 1120B disposed in a foot actuator button 432, 434.

A second set of controls is represented by operation mode control 1340 and volume control 1350. Operation mode control 1340 and volume control 1350 can be embodied as a slide switch that is exposed to an operator of the activity center. Operation mode control 1340 enables selection between a plurality of operating modes. In one embodiment, the plurality of operating modes includes a disabled mode, an infant activated mode that is responsive to infant controls such as foot switches 1320, 1330, and a continuous play mode that is operative to produce pre-programmed infant entertainment effects.

In the schematic circuit diagram of FIG. 13, the pre-programmed infant entertainment effects are generated using a speaker 1370 and lamps LP1–LP8 (e.g., grain of wheat; 4.5 V, 80 mA lights), which correspond to the infant entertainment components illustrated in FIG. 5. These infant entertainment components are activated or controlled by electronic control unit 1310 in response to controls 1320, 1330, 1340, 1350.

While the embodiment described with reference to FIGS. 3–13 illustrates one arrangement of infant entertainment components relative to an electronic control unit, it should be noted that the principles of the present invention enable flexibility in the particular activity center implementation. The flexibility in placement of the controls is enabled through the provision of a communication path between the controls in a first section of the activity center and the electronic control unit in a second section of the activity center. In the embodiment described above, the communication path between controls and the electronic control unit are enabled through the engagement of contacts in retainer member 334 and end member 520.

While the invention has been described in detail and with reference to specific embodiments thereof, it will be apparent to one skilled in the art that various changes and modifications can be made therein without departing from the spirit and scope thereof. Thus, it is intended that the present invention covers the modifications and variations of this invention provided they come within the scope of the appended claims and their equivalents.

What is claimed is:

1. An electronic activity center for an infant user, comprising:

a support frame having a seating surface on which the infant user can be supported;

an actuator disposed on said support frame and positioned to be activated by engagement with the foot of the infant user when supported on said seating surface;

an activity bar;

a coupler mounted to said support frame and releasably engageable with said activity bar to couple said activity bar to said support frame;

an electronic entertainment component mounted to said activity bar, electrically coupled to said actuator, and responsive to electrical signals from said actuator to produce sensible output; and an electrical connector having a first connector portion disposed on said coupler and coupled to said actuator and a second connector portion mounted to said activity bar, coupled to said electronic entertainment component, and releasably engageable with said first connector portion to selectively couple said actuator to said electronic entertainment component.

2. The electronic activity center of claim 1, wherein said electronic entertainment component is spaced above said seating surface and disposed to be visible to the infant user supported on said seating surface.

3. The electronic activity center of claim 1, wherein said support frame includes a base portion and a resilient upper portion coupled to said base portion and to said seating surface and responsive to movement of the infant to produce a bouncing motion.

4. The electronic activity center of claim 1, wherein said actuator is a first actuator and further including a second actuator disposed on said support frame, positioned to be activated by engagement by a foot of the infant, and coupled to said electronic entertainment component.

5. The electronic activity center of claim 4, wherein said electronic entertainment component produces a first sensible output in response to activation of said first actuator and a second sensible output in response to activation of said second actuator.

6. An infant activity center, comprising:

a movement detection portion having an actuator disposed thereon and positioned to be activated by an infant when supported by the infant activity center;

a first coupler disposed on said movement detection portion;

a infant entertainment portion having an infant entertainment component; and a second coupler disposed on said infant entertainment portion, wherein said first coupler and said second coupler provide a removable coupling between said movement detection portion and said infant entertainment portion thereby enabling said infant entertainment component to be responsive to activation of said actuator.

7. The infant activity center of claim 6, wherein said movement detection portion is a support frame adapted to support said infant.

8. The infant activity center of claim 6, wherein said actuator is positioned to be activated by a foot of said infant.

9. The infant activity center of claim 6, wherein at least one of said first coupler and said second coupler includes electrical contacts.

10. The infant activity center of claim 6, wherein said infant entertainment component produces visual output.

11. The infant activity center of claim 6, wherein said infant entertainment component produces audio output.

12. The infant activity center of claim 6, wherein said infant entertainment component includes a hanging component.

* * * * *